United States Patent [19]

Gueussier

[11] Patent Number: 4,617,067

[45] Date of Patent: Oct. 14, 1986

[54] PROCESS FOR THE PRODUCTION OF SEMI-FINISHED ARTICLES OF HARD STEELS USING A CONTINUOUS CASTING OPERATION

[75] Inventor: André Gueussier, Paris, France

[73] Assignee: Vallourec, Paris, France

[21] Appl. No.: 290,529

[22] Filed: Aug. 6, 1981

[51] Int. Cl.[4] ..... C21D 8/00

[52] U.S. Cl. ..... 148/2; 148/12 R; 148/3; 164/486; 164/263; 164/476; 164/477

[58] Field of Search ..... 148/2, 12 R, 3, 12 F, 148/35, 36, 12 B; 29/527.7; 164/147.1, 422, 263, 486, 263, 476, 477

[56] References Cited

U.S. PATENT DOCUMENTS

| | | | |
|---|---|---|---|
| 3,430,684 | 3/1969 | Babel et al. | 164/422 |
| 3,961,994 | 6/1976 | Thome | 148/12 R |
| 4,077,812 | 3/1978 | Tani | 148/36 |
| 4,221,612 | 9/1980 | Thome | 148/35 |

FOREIGN PATENT DOCUMENTS

| | | | |
|---|---|---|---|
| 2129426 | 1/1972 | Fed. Rep. of Germany | 148/2 |

OTHER PUBLICATIONS

Gueussier et al, "Rotary Continuous Casting Enhances Control of Crystallization in Producing Tube Rounds, *Industrial Heating*, Sep. 1982.

Hanley, "Electromagnetic Linear Stirring for Quality Control in Continuous Casting", Industrial Heating, Sep. 1982.

*Primary Examiner*—L. Dewayne Rutledge
*Assistant Examiner*—Deborah Yee
*Attorney, Agent, or Firm*—Dennison, Meserole, Pollack & Scheiner

[57] ABSTRACT

The present invention is directed to a continuous casting process for the production of semi-finished articles or blanks of hard steels such as bars, wires or tubes having a carbon content higher than 0.75%. In this process, the blank obtained by continuous casting is submitted to a secondary cooling under the mold, cut and within three minutes after cutting, introduced into a reheating furnace in which its temperature is brought to a level slightly lower than the solidus temperature, maintained for a short period, and finally elongated in the hot condition. In a preferred embodiment, the liquid steel is stirred during the continuous casting operation by means of magnetic fields induced in the steel by electromagnetic coils disposed around the blank thereby facilitating dissolution of carbides contained within the liquid steel.

11 Claims, No Drawings

PROCESS FOR THE PRODUCTION OF SEMI-FINISHED ARTICLES OF HARD STEELS USING A CONTINUOUS CASTING OPERATION

BACKGROUND OF THE INVENTION

1. Field of the Invention

The present invention relates to a process for the production of semi-finished articles of hard steels in which the carbon content is higher than 0.75%, said process utilizing a continuous casting operation.

The disclosed process can be used in particular but not exclusively for the production of tubular articles intended for the production of ball or roller bearing assemblies. A substantial part of a ball or roller bearing assembly is produced at the present time from a hard steel which complies with standard 100 C6 (US standard 52100) having a mean carbon content of about 1% and a mean chromium content of about 1.5%. Compositions derived therefrom can also be used, which contain trace amounts of chromium and additionally Mo, Mn or other conventional alloying elements.

2. Description of the Prior Art

Semi-finished articles such as bars, wires or tubes, which are made of such steels, are generally produced in accordance with the following conventional operation procedure:

1. preparation of said steel from, for example, pig iron in an electric furnace or converter,
2. casting in the form of ingots,
3. rolling on a blooming mill, and
4. re-rolling on a bar, wire or tube train.

When hard steels, in particular those of the above-indicated type which are hyper-eutectoid, solidify in an ingot mould, inevitable major segregation occurs accompanied by axial concentration of large primary carbide grains having acute angles thus producing grains which are difficult to dissolve and which tend to be retained in the structure of the rolled article. This is due in part to the grains possessing shapes and dimensions which are incompatible with the tempering standards applicable to such steels which normally permits dissolution of the carbides in final hardening operations. To remedy this, these steels require special hot-transformation operations in order to remove such major-segregation hypereutectoid carbides and this is normally accomplished by maintaining the ingot at a high temperature, for example from about $\theta s$ -75° C. $\theta s$ is the temperature of the solidus of the steel the incipient melting point the incipient melting point. This temperature is maintained for several hours so as to cause partial dissolution of the large grains of carbide which are accumulated at the centre of the ingot. Dissolution of those carbides is completed by a rolling operation carried out by the blooming mill directly after the partial dissolution of the carbides.

Experience has shown that applying such a treatment to rough castings of smaller section, such as for example continuous casting billets, gives rise to serious disadvantages. Maintaining the metal at a high temperature during a homogenization treatment leads to large metal losses due to oxidation, and excessive decarburization, with the results that subsequent rolling operation is much less effective in eliminating the carbides. Studies that have been carried out have shown that this is because the core of the rough casting in which the primary carbides are concentrated cools excessively during the rolling operation.

SUMMARY OF THE INVENTION

The present invention provides a process for producing siderurgical articles of hard steels, which overcomes the disadvantages of the prior art and avoids the use of conventional trains for reducing the size of cast items of large section, such as cast ingots or large blooms. This process is characterized in that a square or round blank produced by a continuous casting operation, includes secondary cooling distributed over the first half of the metallurgical casting height of the blank and after cutting of the blank, subjecting same within a delay which is at most equal to three minutes and preferably less than one minute, to re-heating so as to impart thereto a surface temperature which is between $\theta s$- 80° C. and $\theta s$ - 110° C. This re-reheating is maintained for a period of time which is from about 10 minutes to about 30 minutes, then the blank is transformed in the hot condition by working so as to cause elongation by a factor of at least 2, said transformation operation being carried out in such a way that the surface temperature of the blank during the working operation remains higher than from about $\theta s$-140° C.

Regarding the continuous casting operation which is performed in the process according to the invention, the metallurgical height is defined as being the distance between the level of the surface of the liquid metal in the ingot casting mould and the level at which cutting of the blank is effected, which is below the level at which solidification occurs. Thus, in a vertical casting installation, this is the height between those two limit levels, the casting level and the cutting level.

By performing the continuous casting operation as indicated above, it is possible to ensure that the primary carbides are not entirely concentrated at the centre of the blank. The external zone of basaltic crystallization of solidification is thus limited and does not exceed 75% of the area of a blank cross section. Secondary cooling is evenly distributed over the first half of the metallurgical height of the installation, which makes it possible to cool the skin of the blank issuing from the ingot gently and regularly, while avoiding any local re-heating of the skin in order to reduce to the maximum extent the temperature gradient between the core and the surface.

DESCRIPTION OF THE PREFERRED EMBODIMENT

In accordance with a preferred embodiment of the invention, the liquid steel is stirred in the course of the continuous casting operation, in a zone between the middle and the lower quarter of the metallurgical height. This stirring is preferably produced by an upward movement of the liquid steel by means of magnetic fields induced in the steel by electromagnetic coils disposed around the blank. The zone in which the stirring operation is produced substantially corresponds to the level at which equiaxed solidification begins in the core of the blank. The stirring operation must be as intense as possible in order best to refine the internal structure of the steel, and may advantageously be carried out over several regions of the blank in the course of solidification.

The subsequent re-heating phase is carried out in an induction furnace into which the continuously cast blank is introduced as quickly as possible after cutting. The transfer delay must be at most equal to two minutes, for articles whose diameter is less than 150 mm, when the blanks are round, or an equivalent parameter when the blanks are of non-round section; in any event, the period of time in question must be less than 3 minutes for products of larger section.

As indicated above, re-heating of the blank should be maintained for a period of approximately 30 minutes, and be carried out either in the induction furnace itself or in a transfer furnace. The re-heating time should in practice not exceed 30 minutes if excessive surface decarburization is to be avoided.

As stated, the re-heating operation is preferably carried out in an induction furnace which causes a rapid rise in temperature, which makes it possible to maintain the core of the blank at an elevated temperature to facilitate dissolution of the concentrated carbides in that region. Moreover, it is important not to exceed the specified surface temperature of from about $\theta$s-80° C., otherwise difficulties may arise in the subsequent working operation. The operation of transforming the blank in a hot condition by working, with the surface temperature of the blank being maintained at from about $\theta$s-140° C., may be in particular a rolling operation, for example in a rolling mill with inclined planetary rolls, or in a piercing rolling mill with inclined rolls, but it may also be a drawing operation or a forging operation on a machine with a high striking rate. The worked semi-finished article produced by carrying out the process according to the invention may then be subjected to re-heating, depending on the finished article to be produced. Such operations may be for producing tubes for bearing assemblies, hollow rolling, rolling on a mandrel between inclined cylinders, rolling on a mandrel in continuously disposed cages, etc.

Other features and advantages of the invention will be apparent from the following examples which are given by way of illustration and without any limitation whatever.

EXAMPLE 1

Solid round blanks which are 200 mm in diameter and which comprise steel 100 C6 are produced by continuous vertical casting in a rotary ingot mould using the process described in the article "La coulee continue rotative et ses possiblities", Revue de Metallurgie CIT, February 1981, pages 119–135. The metallurgical height of the casting installation is 12 meters. A secondary cooling operation is performed by means of water injection nozzles which are distributed over a total height of 5.5 meters below the mould. Disposed at a distance of 6.5 meters below the mould is an electromagnetic induction means so arranged as to produce a vertical upward circulation of the core liquid steel, over a height of 800 mm.

The blanks are cut up by means of a saw into unitary lengths of 3 meters and, after they have been turned round, they are introduced into horizontal induction re-heating furnaces, the time elapsing between the cutting operation and placing the pieces in the furnace being about one minute. The outside temperature of the blank is thus raised to a temperature of about 1190° C. for about 4 minutes. The solidus temperature of the steel used in 1270° C. The blank is kept in the re-heating furnace for about 8 minutes and then transferred into a gas-fired beam-type furnace which is regulated to a temperature of 1180° C. Such a furnace permits eight blanks to be stored therein.

On issuing from the temperature holding furnace, the blanks are immediately introduced into a rolling mill with inclined planetary rolls, which makes it possible to produce round bars which are 110 mm in diameter, directly in a single pass, from round blanks which are 220 mm in diameter. The rolled bars are 12 meters in length, and have undergone elongation by a factor of 4.

The outside temperature of the blank during the working operation carried out on the rolling mill with inclined planetary rolls does not drop by more than 20° C. while passing through the rolling mill. The blanks are then cut to the desired length and transferred to a cooling installation either for slow cooling or for being isothermally maintained at 650° C. The semi-finished articles produced can then be introduced directly and without any completion operation into a tube piercing and rolling installation or into a bar rolling train to produce rolled articles having the correct structure without undissolved primary carbides still continuing to exist therein.

EXAMPLE 2

The continuous casting operation is carried out under the same conditions as in Example 1 so as to produce blanks which are 3 meters in length and 160 mm in diameter, comprising a steel 100 C6 with a solidus temperature of 1270° C.

After having been cut and turned round, the blanks are introduced within a delay of less than 80 seconds into induction furnaces in which the outside temperature of the blank is adjusted to a temperature of about 1180° C. in a period of time of the order of 200 seconds. That temperature is maintained at from about 1160° C. to about 1180° C. for approximately 4 minutes. The blanks are then transferred into a holding furnace at a temperature of 1170° C., in which they stay for about 20 minutes. The blanks are then introduced into a piercing rolling mill with inclined rolls. The surface temperature of the blank issuing from the rolling mill rolls is from about 1130° C. to about 1150° C.

The working operation in the piercing rolling mill is effected in such a way that the length of the tubular article produced is 8 meters, that is to say, about 2.7 times the length of the blank at entry into the rolling mill. The rolling operation is then continued until a finished tube is produced, under the normal conditions of the conventional processes. The structure of the tube produced is free from undissolved primary carbides.

EXAMPLE 3

The continuous casting operation is performed, followed by the cutting operation, turning operation and re-heating operation as set forth in Example 2, although the operation of cutting the blank is carried out in such a way as to produce blanks which are 3.75 meters in length. On issuing from the temperature-hold furnace, the blank is introduced into the same piercing rolling mill with inclined rolls, as used in Example 2, so as to produce a hollow tubular product with an outside diameter of 167 mm, a thickness of 23 mm and a length of 7.5 m. The blank is passed through the piercing rolling mill with the surface temperature of the metal higher than 1140° C., with the blank having undergone elongation by a factor of 2.

The resulting semi-finished product is then re-heated rapidly in an induction furnace to produce a homogenous temperature in the metal of the order of about 1160° C., and it is then rolled on a mandrel in a rolling mill with three inclined rolls, producing a tube which is 148 mm in diameter and 19 mm in thickness. This tube, which is produced in a 10 meter length, then passes through the cages of a reducing mill which produces a finished tube which is 120 mm in diameter, 20 mm in thickness and 11.8 meters in length. The structure of this tube, which comprises steel 100 C6, is correct and free from undissolved primary carbides.

Although the invention has been described in relation to particular embodiments, it will be appreciated that the invention is in no way limited thereto and that many variations and modifications may be made therein without departing from the spirit or scope of the invention.

I claim:

1. In a process for producing a semi-finished article from a blank of hard steel having a carbon content greater than about 0.75% wherein the blank is produced by a continuous casting process including a step of secondary cooling the continuous casting by subjecting the casting to a coolant distributed over the first half of the metallurgical casting height followed by cutting the casting to form the blank, the improvement comprising the steps of:

(a) subjecting the blank within about 1 minute to about 3 minutes after cutting from the casting to reheating to impart thereto a surface temperature which is between about $\theta$s less 80° C. and about $\theta$s less 110° C.;

(b) maintaining said reheating of (a) for a period of from about 10 minutes to about 30 minutes;

(c) transforming said reheated blank of (b) while in the hot condition by working to elongate the blank by a factor of at least 2; and (d) maintaining the surface temperature of the blank throughout the transformation step higher than about $\theta$s less 140° C.

2. The process according to claim 1 wherein, during the continuous casting operation, the liquid core of the siderurgical article or blank is stirred in a zone from about the middle to about the lower quarter of the metallurgical height of said article.

3. A process according to claim 1 or claim 2 where in the operation of continuous casting the blank is carried out in a rotary ingot mould.

4. A process according to claim 1, 2 or 3 wherein that the operation of re-heating the blank is carried out in an induction furnace.

5. A process according to claim 1, 2 or 3 where in the operation of re-heating the blank is performed successively in an induction furnace and in a holding furnace.

6. A process according to claim 1, 2, 3, 4, or 5, where in the working operation is a rolling operation.

7. A process according to claim 6 wherein the rolling operation is carried out in a rolling mill with inclined planetary rolls.

8. A process according to claim 6 wherein the rolling operation is carried out in a piercing rolling mill having inclined rolls.

9. A process according to claim 1, 2, 3, 4 or 5 wherein the working operation is a drawing operation.

10. A process according to claim 1, 2, 3, 4 or 5 where in the working operation is a forging operation,

11. A process according to claim 1, 2, 3, 4 or 5 where in a semi-finished product produced by said process is rolled, after a re-heating step.

* * * * *